US005961673A

United States Patent [19]

Topf et al.

[11] Patent Number: 5,961,673

[45] Date of Patent: Oct. 5, 1999

[54] PROCESS AND APPARATUS FOR PRODUCING FUEL GAS

[75] Inventors: Norbert Topf, Dresden; Guenter Reichert, Essen; Dieter Hahn; Guenter Liebisch, both of Dresden, all of Germany

[73] Assignee: VER Verwertung und Entsorgung von Reststoffen GmbH, Dresden, Germany

[21] Appl. No.: 08/981,016

[22] PCT Filed: Jun. 26, 1996

[86] PCT No.: PCT/DE96/01122

§ 371 Date: Dec. 23, 1997

§ 102(e) Date: Dec. 23, 1997

[87] PCT Pub. No.: WO97/01618

PCT Pub. Date: Jan. 16, 1997

[30] Foreign Application Priority Data

Jun. 27, 1995 [WO] WIPO ..... PCT/DE95/00816

[51] Int. Cl.[6] ..... C10J 1/28; C07C 1/00; B09B 3/00

[52] U.S. Cl. ..... 48/197 R; 48/76; 48/123; 585/240; 110/235; 110/248

[58] Field of Search ..... 48/76, 89, 98, 48/99, 97, 123, 197 R; 585/240; 201/22; 202/91, 124; 110/235, 248

[56] References Cited

U.S. PATENT DOCUMENTS

| | | | |
|---|---|---|---|
| 4,388,082 | 6/1983 | Guttman et al. | 48/76 |
| 4,747,355 | 5/1988 | van Berkum | 110/229 |

FOREIGN PATENT DOCUMENTS

| | | |
|---|---|---|
| 0433547 | 6/1991 | European Pat. Off. . |
| 377222 | 3/1921 | Germany . |
| 926978 | 7/1954 | Germany . |
| 3042200 | 6/1982 | Germany . |
| 3312863 | 10/1984 | Germany . |
| 3409292 | 9/1985 | Germany . |
| 3705406 | 9/1988 | Germany . |
| 3816085 | 11/1989 | Germany . |
| 377767 | 8/1932 | United Kingdom . |

*Primary Examiner*—Hien Tran
*Assistant Examiner*—James Kennedy
*Attorney, Agent, or Firm*—Jordan and Hamburg LLP

[57] ABSTRACT

The invention concerns a process and apparatus for gasifying carbon-containing products, in particular waste and residues conditioned or processed in a suitable way. Gasification takes place in a mixed flow composed of a counter flow, direct flow and transverse flow. A portion of the gasifying agent is introduced through an inclined grate in the form of a step grate and thrust grating and ash is removed at the bottom end of the grate. Fuel gas is drawn off above the upper level of the grate on the side opposite the lateral feed of the gasifying agent. The gasification apparatus is enclosed in a double-layer insulating/cooling system in which air is used as the insulator and coolant. The gasification process is regulated by the temperature profile of the gasification apparatus, the position of the principal gasification zone is adjusted by ash discharge, the gasification temperature is regulated by the flow of gasifying agent and the output is regulated by the width of the gasification zone. The fuel gas produced is used preferably for generating electricity in a work machine. Exhaust gases are purified preferably with the aid of an active coke filter.

4 Claims, 1 Drawing Sheet

PROCESS AND APPARATUS FOR PRODUCING FUEL GAS

BACKGROUND OF THE INVENTION

The invention relates to a method of an arrangement for producing fuel gas from carbonaceous products, in particular from waste and residual materials conditioned or processed in a suitable manner.

PRIOR ART

German Offenlegungsschrift 33 12 863 discloses a method of burning combustible material in which combustible exhaust gases are fed to a combustion chamber. In this case, the exhaust gases are separately directed from inside the combustion chamber to its outlet or outlets, and fresh air is admixed to the separately directed exhaust gases. Thus, as far as possible, complete and trouble-free burn-out of the exhaust gases is to be made possible.

German Patent 34 09 292 and German Patent 37 05 406 disclose gas generators in a construction unit having a combustion chamber as so-called gasification heating boilers. These consist of a charging shaft arranged above a movable grate, a reaction space adjoining the charging shaft above the grate, a combustion chamber arranged below the grate, and a flame tube provided inside the combustion chamber.

Due to the gasification control in this gasification heating boiler as parallel-flow gasification, in the course of which the material to be gasified and the gasification medium pass through the gasification apparatus from top to bottom and the fuel gas produced is drawn off in direct proximity to the ash discharge, carbon particles are discharged by the fuel gas and thus problems occur during the combustion of the gas in the form of too high a residual CO content in the exhaust gas.

The object of the invention is to increase the purity of the gas produced and, thus, to broaden its utility, combined with complete utilization of the carbon contained in the waste or residual material used, optimum utilization of the fuel gas produced, and minimization of the pollutant discharge due to the combustion exhaust gases issuing after the extraction of heat.

SUMMARY OF THE INVENTION

The object is achieved according to the invention in that, according to the method, the waste or residual materials, which are conditioned or processed in a suitable manner, are gasified as solids in a gasification apparatus by air or a gas mixture, which contains air or oxygen, as gasification medium. In this case, the material to be gasified and the gasification medium are directed in mixed flow by virtue of the fact that the solid to be gasified passes through the gasification furnace from top to bottom, and the gasification medium is fed to the solid filling both from above and from below and at the side, but at least at the side and at one of the other said locations, and the fuel gas is preferably drawn off at the side opposite the lateral feed of the gasification medium.

DETAILED DESCRIPTION OF THE INVENTION

Figure 1:
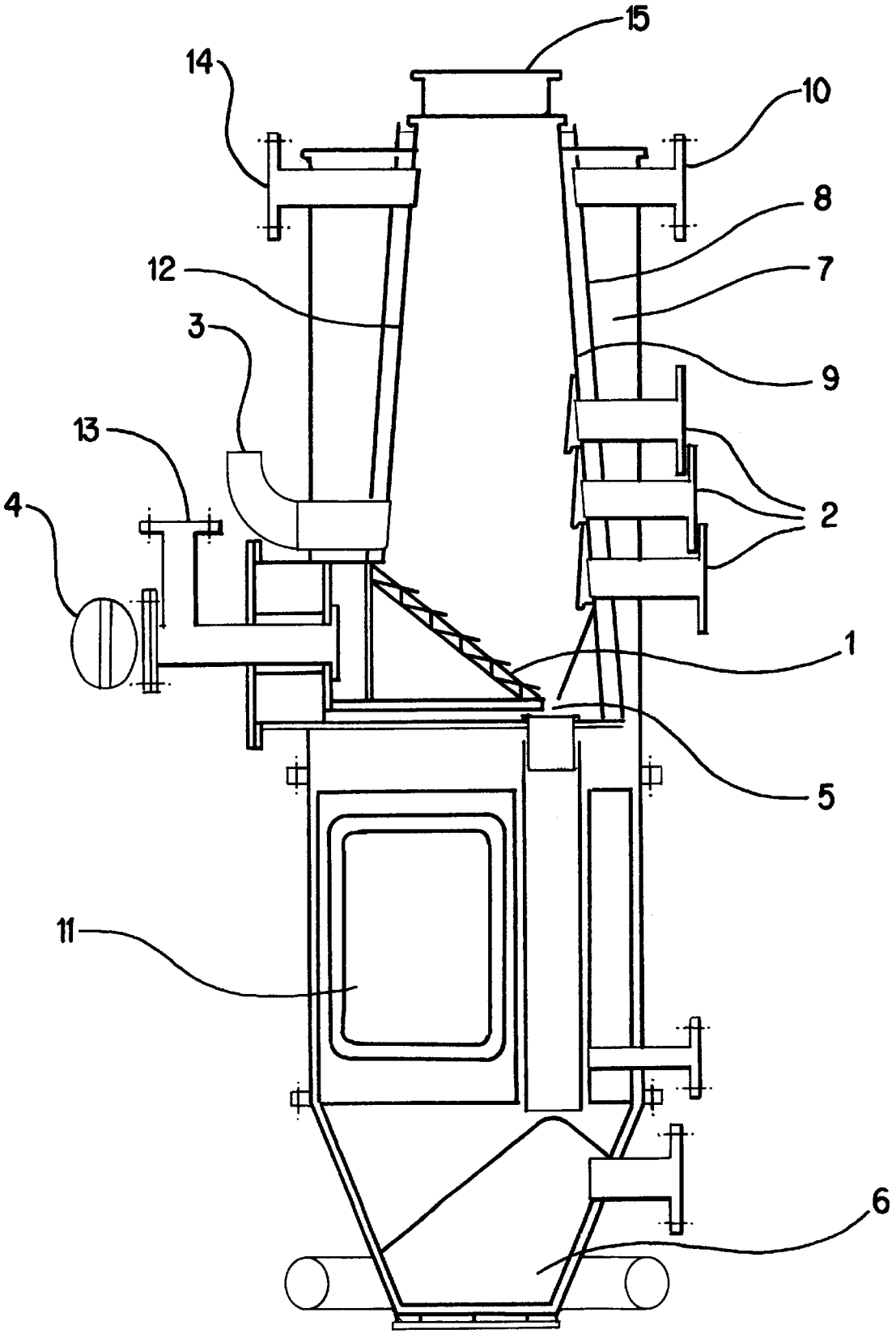
FIG. 1 is an elevational view of a gasification apparatus.

The gasification operation in the gasification apparatus is regulated according to the invention by recording the temperature profile over the height of the gasification apparatus. In this case, the position of the main gasification zone, in accordance with the maximum temperature zone, is regulated via the movement of the sliding grate and, thus, via the ash discharge. The optimum gasification temperature, which differs according to the type of waste or residual material, is regulated via the size and composition of the gasification-medium flow, and the output of the gasification furnace is regulated via the width of the gasification-medium feed by feed locations arranged one above the other.

The fuel gas produced can be fed completely or partly, without further processing, to a combustion chamber, which is arranged under the gasification apparatus in a construction unit and is of a type of construction known per se, and the combustion gases which develop can be thermally utilized. However, the fuel gas is advantageously fed to a machine for generating electrical energy. The residual heat is thermally utilized by means of a waste-heat boiler. After the extraction of heat, the combustion exhaust gas is subjected to flue-gas purification, which preferably includes an activated coke filter, and subsequently passes via a chimney into the atmosphere.

The arrangement for producing fuel gas by gasification of carbonaceous products, in particular from waste and residual materials conditioned or processed in a suitable manner, in a gasification apparatus, preferably in a construction unit having a combustion chamber, by air or a gas mixture, which contains air or oxygen, gasification medium is defined in that the gasification apparatus is equipped with an inclined grate, which is preferably designed as a stepped grate, which permits the feeding of the gasification medium and can be set in a sliding motion via a suitable mechanism.

The gasification apparatus is surrounded by a double-layer insulating/cooling system, the layers of which are separated by a perforated intermediate wall, the outer insulating layer having one or more openings for introducing the cooling air and the inner cooling layer having one or more openings for withdrawing the cooling air.

The invention is to be explained in more detail below with reference to an exemplary embodiment.

The basic construction of the arrangement according to the invention is explained in FIG. 1. Carbonaceous particles are fed to a gasification apparatus through inlet 15. The gasification apparatus according to the invention is equipped with an inclined grate 1, a portion of the gasification medium being fed via a feed 13 and through this grate 1 to the material to be gasified and mainly having the task of completely transforming the carbon still present in the ashes of the charging stock. A further portion of the gasification medium is fed via a feed 14 to the gasification furnace above the solid filling and mainly has the task of flushing low-temperature carbonization products of the material to be gasified into the gasification zone and thus of feeding them for complete gasification. The main quantity of the gasification medium is fed to the gasification apparatus at the side via a feed 2. The dimensions of the gasification zone and thus the gasification output can be determined by varying the width of the lateral gasification-medium feed. In the case of a direction of flow of the material to be gasified from top to bottom, a counterflow is realized in the bottom part of the gasification apparatus, a parallel flow is realized in the top part, and a cross flow is realized in the center part, the main gasification zone. The fuel gas is drawn off at an outflow 3 at the side opposite the lateral feed 2 above the topmost step of the inclined grate 1. By the mixed-flow gasification according to the invention, complete conversion of the carbon contained in the material to be gasified is achieved on the one hand, and complete transformation of the low-temperature carbonization products which primarily arise is achieved on the other hand, so that the fuel gas is free of condensable, organic and tar-like materials.

The inclined grate 1 is designed according to the invention as a stepped grate or otherwise so as to differ from a flat form and is movably mounted as a sliding grate. By the sliding motion via a suitable drive 4, the ashes are discharged via a discharge opening 5 and pass into the ash-collecting space 6. Due to the spatially separate discharge of fuel gas and ashes, the fuel gas is largely free of carbonaceous and mineral floating particles.

A further feature of the invention is the insulating/cooling system around the gasification apparatus. The cooling air passes first of all into an outer insulating layer 7 and from there through the perforated intermediate wall 8 into an inner cooling layer 9, where the actual cooling of the gasification-furnace shell 12 is effected. The preheated air leaves the insulating/cooling system at an outflow 10 and is used as gasification medium or combustion air.

As already described, the gasification operation in the gasification apparatus is regulated by recording the temperature profile over the height of the gasification apparatus In this case, the position of the main gasification zone, in accordance with the maximum temperature zone, is regulated via the movement of the grate 1 and thus by the ash discharge. The optimum gasification temperature, which differs according to the type of waste or residual material, is regulated via the size and composition of the gasification-medium flow, and the output of the gasification apparatus is regulated via the width of the gasification zone in accordance with the width of the gasification-medium feed by a plurality of feeds 2 arranged one above the other.

The fuel gas produced can be fed completely or partly, without further processing, to a combustion chamber 11, which is arranged under the gasification apparatus in a construction unit and is of a type of construction known per se, and the combustion gases which develop can be thermally utilized. However, the fuel gas is advantageously fed to a machine for generating electrical energy. The residual heat is thermally utilized by means of a waste-heat boiler. After the extraction of heat, the combustion exhaust gas is subjected to flue-gas purification, preferably with the use of an activated coke filter, and subsequently passes via a chimney into the atmosphere.

We claim:

1. A method of regulating the production of fuel gas from carbonaceous solids comprising:

supplying at least one carbonaceous solid to a gasification apparatus having an upper portion with a gasification medium inlet and a carbonaceous solid inlet, a bottom portion with a gasification medium inlet and side portions with a first side portion having at least one gasification medium inlet and a second side portion opposite said first side portion having a fuel gas outlet, the at least one carbonaceous solid being supplied to a feed inlet in the upper portion of the apparatus and travelling to the bottom portion of the apparatus where any remaining solid from the carbonaceous solid is deposited as ash;

supplying a gasification medium to at least one side portion of said gasification apparatus and supplying a gasification medium to at least the upper portion and the bottom portion to form a gasification zone by the convergence of the gasification media from the side portion and the upper portion and/or the bottom portion of the apparatus, the gasification medium being air or a gas mixture containing oxygen;

converting carbon in the carbonaceous solid to fuel gas as the carbonaceous solid travels from the upper portion of the apparatus through the gasification zone formed by the convergence of the gasification medium to the bottom portion of the apparatus;

discharging ash from the bottom portion of the apparatus;

adjusting the position of the gasification zone by regulating the rate of the ash discharge from the gasification apparatus;

recording the temperature profile over the height of the gasification apparatus;

regulating the temperature of the converting step by adjusting the supply of the gasification medium; and adjusting the size of the gasification zone by increasing or decreasing the number of vertically arranged gasification medium inlets in the first side portion of the apparatus through which gasification medium is supplied to said gasification apparatus, thereby regulating the amount of fuel gas exiting the fuel gas outlet.

2. An apparatus for producing fuel gas from carbonaceous solids comprising: a gasification furnace having an upper portion, a bottom portion and side portions with at least a first and second side portion, the first side portion being opposite the second side portion; a carbonaceous solid inlet in the upper portion of the furnace for supplying a carbonaceous solid to the furnace and an upper gasification medium inlet communicating with the upper portion of the furnace; a lower gasification medium inlet communicating with the bottom portion of the furnace; a plurality of side gasification medium inlets arranged one above another and communicating with the first side portion for supplying a gasification medium to the furnace; a fuel gas outlet communicating with the second side portion for outletting fuel gas from the furnace; the carbonaceous solid being subjected to a gasification medium supplied from at least one of the plurality of side gasification medium inlets and at least one of the upper and lower gasification medium inlets for converting carbon in the carbonaceous solid to fuel gas and yielding solid ash, the fuel gas being withdrawn from the furnace through the fuel gas outlet, the bottom portion of the furnace having a bottom surface on which the solid ash is deposited, the bottom surface having a discharge opening through which the ash is discharged; an inclined gas-permeable grate being arranged in the bottom portion of the furnace below the fuel gas outlet and communicating with the bottom surface of the bottom portion of the furnace, the gas-permeable grate being positioned in front of the lower gasification medium inlet, whereby the gasification medium entering the furnace through the lower gasification medium inlet travels through the inclined gas-permeable grate; and a driving means engaging the grate for sliding the grate along the bottom surface of the bottom portion to sweep the ash into the discharge opening, thereby discharging the ash from the furnace.

3. The apparatus as claimed in claim 2, wherein the grate is a stepped grate.

4. The apparatus as claimed in claim 2 or 3, wherein the furnace further comprises a side wall, an outer wall, a perforated intermediate wall interposed between the side wall and the outer wall to form an outer space between the outer wall and the perforated intermediate wall and an inner space between the perforated intermediate wall and the side wall, and an outlet communicating with the inner space, whereby a cold combustion medium in the outer space travels through the perforated intermediate wall into the inner space where it is heated by heat radiated from the furnace, and the heated combustion medium escapes through the outlet.

* * * * *